US009377723B2

(12) United States Patent
Tamiya

(10) Patent No.: US 9,377,723 B2
(45) Date of Patent: Jun. 28, 2016

(54) STAINLESS-STEEL SEAMLESS BELT AND MANUFACTURING METHOD THEREFOR, FIXING BELT AND HEAT FIXING APPARATUS

(71) Applicant: CANON KABUSHIKI KAISHA, Tokyo (JP)

(72) Inventor: Hirotomo Tamiya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

(21) Appl. No.: 14/245,104

(22) Filed: Apr. 4, 2014

(65) Prior Publication Data

US 2014/0216615 A1 Aug. 7, 2014

Related U.S. Application Data

(62) Division of application No. 13/179,932, filed on Jul. 11, 2011, now abandoned.

(30) Foreign Application Priority Data

Jul. 16, 2010 (JP) ..... 2010-161411
Jul. 8, 2011 (JP) ..... 2011-151979

(51) Int. Cl.

| | |
|---|---|
| ***G03G 15/20*** | (2006.01) |
| ***B21D 22/12*** | (2006.01) |
| ***C21D 6/00*** | (2006.01) |
| ***C21D 9/00*** | (2006.01) |
| ***B21D 35/00*** | (2006.01) |

(52) U.S. Cl.

CPC ..... *G03G 15/2003* (2013.01); *B21D 22/125* (2013.01); *B21D 35/00* (2013.01); *C21D 6/002* (2013.01); *C21D 9/0068* (2013.01); *G03G 15/2053* (2013.01); *G03G 2215/2035* (2013.01)

(58) Field of Classification Search

CPC ..... G03G 15/2003; G03G 15/2053; G03G 2215/2035; C21D 9/0068; C21D 6/002; C21D 7/13; C21D 7/02; C21D 8/00; B21D 35/00; B21D 22/125; B21D 22/20; B21D 22/21; B21D 22/22; B21D 22/28; B21D 22/30; B21D 24/16; B21D 39/08; B21D 39/20; B21D 39/203; B21D 39/206; B21D 53/14

USPC ..... 148/605, 609, 610, 653

See application file for complete search history.

(56) References Cited

U.S. PATENT DOCUMENTS

| | | | | |
|---|---|---|---|---|
| 2,150,708 | A * | 3/1939 | Andrews et al. | 72/338 |
| 2,358,799 | A * | 9/1944 | Franks | 148/610 |
| 3,420,089 | A * | 1/1969 | Myers | 72/351 |
| 3,433,040 | A * | 3/1969 | Lenz | 72/85 |

(Continued)

FOREIGN PATENT DOCUMENTS

| | | |
|---|---|---|
| JP | 2001-074173 | 3/2001 |
| JP | 2001-225134 | 8/2001 |

(Continued)

*Primary Examiner* — David Bryant
*Assistant Examiner* — Lawrence Averick
(74) *Attorney, Agent, or Firm* — Fitzpatrick, Cella, Harper & Scinto

(57) ABSTRACT

Provided is a stainless-steel seamless belt formed by subjecting a stainless-steel plate to a plastic forming process and having a thickness of 50 μm or less. The seamless belt has a bending durability of 100,000 or more times in a specific bending test and has a Vickers hardness of 450 (Hv) or more.

2 Claims, 6 Drawing Sheets

(56) References Cited

U.S. PATENT DOCUMENTS

| | | | | |
|---|---|---|---|---|
| 3,893,326 | A * | 7/1975 | Oberlander et al. | 72/347 |
| 5,573,140 | A | 11/1996 | Satomi et al. | |
| 6,561,001 | B2 | 5/2003 | Sakuma et al. | |
| 6,794,611 | B2 | 9/2004 | Kataoka et al. | |
| 6,898,397 | B2 | 5/2005 | Sakuma et al. | |
| 7,389,079 | B2 | 6/2008 | Narahara et al. | |
| 7,537,838 | B2 | 5/2009 | Hirabayashi et al. | |
| 2001/0007846 | A1 | 7/2001 | Sakuma et al. | |
| 2002/0104351 | A1 | 8/2002 | Sakuma et al. | |
| 2003/0038125 | A1 * | 2/2003 | Kataoka et al. | 219/216 |
| 2003/0121558 | A1 * | 7/2003 | Cook et al. | 138/98 |
| 2007/0258742 | A1 | 11/2007 | Narahara et al. | |

FOREIGN PATENT DOCUMENTS

| | | |
|---|---|---|
| JP | 3970122 | 6/2007 |
| JP | 2007-249186 | 9/2007 |

* cited by examiner

PRIOR ART

STAINLESS-STEEL SEAMLESS BELT AND MANUFACTURING METHOD THEREFOR, FIXING BELT AND HEAT FIXING APPARATUS

This is a divisional of U.S. patent application Ser. No. 13/179,932, filed Jul. 11, 2011, pending.

BACKGROUND OF THE INVENTION

1. Field of the Invention

The present invention relates to a stainless-steel seamless belt for use in a base material of a fixing belt for use in a heat fixing apparatus of an electrophotographic image forming apparatus, and a manufacturing method therefor. In addition, the present invention relates to a fixing belt and a heat fixing apparatus for use in the electrophotographic image forming apparatus.

2. Description of the Related Art

The electrophotographic image forming apparatus uses a heat fixing apparatus for fixing an unfixed toner image on a recording material surface.

Recent heat fixing apparatuses use a power-saving ceramic heater as a heat source to heat a resin belt or a metal belt with a small heat capacity. FIG. 2 schematically illustrates an example of the heat fixing apparatus. In the heat fixing apparatus illustrated in FIG. 2, a heat-resistant belt (fixing belt 33) is interposed between a ceramic heater 31 as a heat source and a pressure roller 35 as a pressure member to form a fixing nip portion 36. In the fixing nip portion 36, a recording material P bearing an unfixed toner image T to be subjected to heat fixing is introduced between the fixing belt 33 and the pressure roller 35. The recording material P is conveyed with being sandwiched between the fixing belt 33 and the pressure roller 35. Thus, in the fixing nip portion 36, heat of the ceramic heater 31 is transmitted to the recording material P through the fixing belt 33. The heat and the pressure allow the unfixed toner T on the recording material P to be fixed to the recording material P. In FIG. 2, the heat fixing apparatus further includes a belt guide member 32 and a pressurizing rigid stay 34.

Examples of materials of the fixing belt for use in such a heat fixing apparatus generally include a heat-resistant resin, and particularly include a polyimide resin excellent in heat-resistance and strength. Unfortunately, with a recent improvement in process speed, the resin fixing belt has insufficient thermal conductivity. In other words, it may be difficult to fix an unfixed toner image to a recording material in a short time and in a sufficient manner. In light of this, there has been proposed that the fixing belt is provided with a base layer containing a metal excellent in thermal conductivity such as stainless steel, nickel, aluminum, and copper (see Japanese Patent No. 3970122).

Japanese Patent No. 3970122 describes a method of manufacturing a stainless base layer. Specifically, the following method is described as a first embodiment.

First, a step is performed of obtaining a cup-shaped stainless cylindrical member (a first-stage metal tube) by subjecting a stainless metal flat plate to a deep-drawing process a plurality of times. Next, a step is performed of obtaining a seamless belt (a second-stage metal tube) by cutting a cup base portion by performing an ironing process using a general spinning drawing process to form a stainless cylindrical member with a predetermined thickness or by performing an ironing process using a continuous die while rotating the first-stage metal tube. Finally, a metal belt of a desired inverted crown shape (a third-stage metal tube) is obtained by subjecting the second-stage metal tube to a hydraulic bulge forming process followed by internal pressure load and plastic forming processes.

Further, as a second embodiment, there is proposed a manufacturing method which includes obtaining a metal belt by performing a complete annealing process at 800° C. to 1,100° C., between the steps of obtaining the second-stage metal tube and the third-stage metal tube according to the first embodiment.

Furthermore, as a third embodiment, there is proposed a method which includes obtaining a metal belt of an inverted crown shape (a third-stage metal tube) by controlling the pressure and the speed at the spinning drawing process in the step of obtaining the second-stage metal tube according to the first embodiment.

SUMMARY OF THE INVENTION

According to the study made by the present inventor, the seamless belt obtained by the first and third embodiments according to Japanese Patent No. 3970122 is repeatedly bent in the nip portion, and the stress has caused a metal fatigue to be accumulated, leading to damage such as breaks and cracks. Further, as to the seamless belt obtained by the second embodiment, the metal belt may be softened to reduce the hardness by the complete annealing at 800° C. to 1,100° C. and worn due to sliding with the ceramic heater. Thus, the present inventor has confirmed his recognition that the metal seamless belt according to Japanese Patent No. 3970122 still needs more improvement in the durability.

In view of this, the present invention is directed to providing a stainless-steel seamless belt which is excellent in durability and difficult to crack and break even at the time of repeated bending, and the manufacturing method therefor.

Further, the present invention is directed to providing a fixing belt having high durability.

Furthermore, the present invention is directed to providing a heat fixing apparatus which can fix an unfixed toner image to a recording material in a stable manner.

According to one aspect of the present invention, there is provided a stainless-steel seamless belt which is formed by subjecting a stainless-steel plate to a plastic forming process and having a thickness of 50 μm or less, wherein, in a bending test in which a strip-like stainless-steel test specimen with a width of 20 mm and a length of 45 mm, formed by cutting the seamless belt into a width of 20 mm along a peripheral direction thereof and cutting open in a direction perpendicular to the peripheral direction, is bent by causing a side support plate having a rotating shaft on one side and rotating around the rotating shaft to repeatedly reciprocate from a top dead point having an opening distance of 29 mm to a bottom dead point having an opening distance of 5.5 mm at a speed of 400 rpm, the strip-like stainless-steel test specimen has a bending durability of 100,000 or more times and wherein a Vickers hardness of the seamless belt is 450 (Hv) or more.

Further, according to another aspect of the present invention, there is provided a method of manufacturing a stainless seamless belt, comprising: (1) obtaining a cup-shaped member by subjecting the stainless-steel plate to a drawing process; (2) obtaining a thin-walled sleeve by subjecting the cup-shaped member to a plastic forming process to be thin-walled and cutting a base portion of the thin-walled cup-shaped member; (3) inserting the thin-walled sleeve into a cylindrical outer die having an internal diameter larger than an external diameter of the thin-walled sleeve so as to be coaxial with the cylindrical outer die, pressurizing the thin-walled sleeve from an inside thereof so as to cause the thin-walled sleeve to closely contact an inner wall of the outer die, and thereby expanding a diameter of the thin-walled sleeve; and (4) subjecting the thin-walled sleeve whose diameter is expanded in (3) to low temperature annealing at 200 to 400° C., wherein the step (3) includes expanding the diameter of the thin-walled sleeve without changing the length in a direction perpendicular to the peripheral direction of the thin-walled sleeve.

Furthermore, according to still another aspect of the present invention, there is provided a fixing belt comprising the seamless belt, an elastic layer, and a toner releasing layer in that order.

Still furthermore, according to the present invention, there is provided a heat fixing apparatus comprising the fixing belt, a heater arranged in contact with an inner peripheral surface of the fixing belt, and a pressure roller forming a fixing nip together with the fixing belt.

Further features of the present invention will become apparent from the following description of exemplary embodiments with reference to the attached drawings.

BRIEF DESCRIPTION OF THE DRAWINGS

FIG. 3A is a cross-sectional view illustrating a state in which the seamless belt is inserted into a bulge die of a hydraulic bulge forming apparatus. FIG. 3B is a cross-sectional view illustrating a state in which an internal pressure load is applied to inside the bulge inner die. FIG. 3C is a cross-sectional view illustrating a state in which a pressurized fluid is removed from the bulge inner die and after pressurization completes. FIG. 3D is a cross-sectional view illustrating a state in which the seamless belt is being discharged from the hydraulic bulge forming apparatus.

FIG. 7A is a before-internal-pressure-load state diagram, and FIG. 7B is a during-internal-pressure-load state diagram.

DESCRIPTION OF THE EMBODIMENTS

Figure 1A:
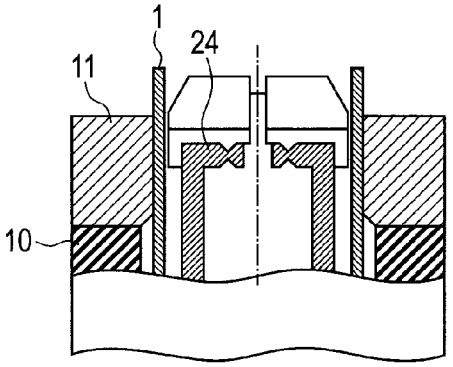
FIG. 1A is a before-internal-pressure-load state diagram of a hydraulic bulge forming method used in embodiments of the present invention.

Preferred embodiments of the present invention will now be described in detail in accordance with the accompanying drawings.

The present inventor has focused attention on the finding that a stainless steel subjected to a cold plastic forming process improves hardness and fatigue strength through low temperature annealing.

In light of this, in order to further improve a dislocation density of the seamless belt in a thickness direction thereof, the thin-walled seamless belt having been subjected to a cold ironing process is further subjected to a plastic forming process of expanding a diameter thereof so as not to change the length in a direction perpendicular to the peripheral direction. Subsequently, the seamless belt is subjected to low temperature annealing in a temperature range of 200 to 400° C. Thus, the stainless-steel seamless belt is obtained which has high hardness and is excellent in bending-resistant fatigue characteristics.

Here, bulge forming is used as the diameter expansion method. When the diameter of a thin-walled sleeve is expanded by the general bulge forming, the diameter of the thin-walled sleeve is expanded while the length in a direction perpendicular to the peripheral direction is reduced. In contrast to this, the present invention expands the diameter of the thin-walled sleeve without changing the length in a direction perpendicular to the peripheral direction. Thus, a large shear stress is applied to the thin-walled sleeve in a direction perpendicular to the ironing direction, namely, in a direction of diameter expansion. As a result, it is considered that the dislocation density effective in increasing the strength of the seamless belt can be increased.

Further, following the diameter expansion by the bulge forming, low temperature annealing is performed. Thus, the dislocation in the thin-walled sleeve is considered to be able to be fixed in a crystal of the stainless steel. More specifically, the seamless belt having a high dislocation density has a high strength by itself, but when the seamless belt is repeatedly bent, the stress due to the bending moves the dislocation from inside to the surface of the seamless belt, which is considered to cause cracks. Meanwhile, the low temperature annealing is considered to be able to prevent a dislocation from easily moving even by the bending in such a manner that a dislocation originally having a high potential energy is fixed to a heterogeneous element or a point fault in the stainless steel to thereby reduce the potential energy.

For the above reason, the stainless-steel seamless belt obtained by the method of the present invention is considered to have both high hardness and excellent bending durability as follows.

Vickers hardness of 450 (Hv) or more;

Bending durability of 100,000 or more times in a bending test in which a strip-like stainless test specimen with a width of 20 mm and a length of 45 mm formed by cutting the seamless belt into a width of 20 mm along a peripheral direction thereof and cutting open the seamless belt in a direction perpendicular to the peripheral direction is bent by causing a side support plate having a rotating shaft on one side and rotating around the rotating shaft to repeatedly reciprocate from a top dead point having an opening distance of 29 mm to a bottom dead point having an opening distance of 5.5 mm at a speed of 400 rpm.

Now, embodiments of the present invention will be described in detail.

The stainless seamless belt according to the present invention is formed by subjecting a stainless-steel plate to a plastic forming process to have a thickness of 50 μm or less. Further, the stainless seamless belt has a bending durability of 100,000 or more times in a bending test in which a strip-like stainless test specimen with a width of 20 mm and a length of 45 mm, formed by cutting the seamless belt along a peripheral direction thereof and further cutting it into a width of 20 mm and cutting open the seamless belt in a direction perpendicular to the peripheral direction, is bent by causing a side support plate having a rotating shaft on one side and rotating around the rotating shaft to repeatedly reciprocate from a top dead point having an opening distance of 29 mm to a bottom dead point having an opening distance of 5.5 mm at a speed of 400 rpm. Furthermore, the stainless seamless belt has a Vickers hardness of 450 (Hv) or more.

The aforementioned stainless seamless belt having high hardness and excellent in bending resistance can be manufactured by a method including the following steps (1) to (4).

(1) A cup-shaped member is obtained by subjecting a stainless-steel plate to a drawing process.

(2) A thin-walled sleeve is obtained by subjecting the cup-shaped member obtained in step (1) to a plastic forming process to be thin-walled and cutting a base portion of the thin-walled cup-shaped member.

(3) The thin-walled sleeve obtained in step (2) is inserted into a cylindrical outer die having an internal diameter larger than an external diameter of the thin-walled sleeve so as to be coaxial with the cylindrical outer die. The thin-walled sleeve is pressurized from inside thereof so as to cause the thin-walled sleeve to closely contact an inner wall of the outer die. At this time, it is necessary to expand a diameter of the thin-walled sleeve without changing the length in a direction perpendicular to the peripheral direction of the thin-walled sleeve.

(4) Then, the thin-walled sleeve obtained in step (3) with expanded diameter is subjected to low temperature annealing at 200 to 400° C.

The step (3) differs from the conventional bulge forming in that when a thin-walled sleeve arranged inside the cylindrical outer die coaxially with the cylindrical outer die is pressurized from inside the thin-walled sleeve to closely contact an inner wall of the cylindrical outer die to expand the diameter, the length in a direction perpendicular to the peripheral direction of the thin-walled sleeve, namely, the length in the axial direction is not changed. In general bulge forming, with the diameter expansion of the thin-walled sleeve, the length along the axial direction of the thin-walled sleeve is reduced.

In contrast to this, the present invention is devised to prevent a change in the length along the axial direction of the thin-walled sleeve even in an advancement of diameter expansion of the thin-walled sleeve. Specifically, for example, both ends of a thin-walled sleeve are clamped by both ends of a cylindrical mold.

Thus, when the change in the length in a direction perpendicular to the peripheral direction of the thin-walled sleeve is suppressed in the diameter expansion step, a larger shear stress is added to the thin-walled sleeve during diameter expansion. As a result, many lattice defects called dislocations can be generated in a crystal of stainless steel constituting the thin-walled sleeve. Thus, the dislocation density in the crystal of stainless steel increases and the strength of a thin-walled sleeve 1 increases. The dislocation at this time, however, is considered to be easily moved when an external force such as bending is added to the thin-walled sleeve. When repeated bending causes a dislocation to move near the surface of a thin-walled sleeve, the dislocation is considered to cause cracks or breaks to be generated in the thin-walled sleeve.

In light of this, the thin-walled sleeve 1 with increased dislocation density in the crystal is subjected to low temperature annealing in step (4). Thus, the dislocation is fixed to a point fault in the stainless steel. The resulting thin-walled sleeve can be used as a seamless belt having high hardness and excellent in bending resistance.

Figure 10:
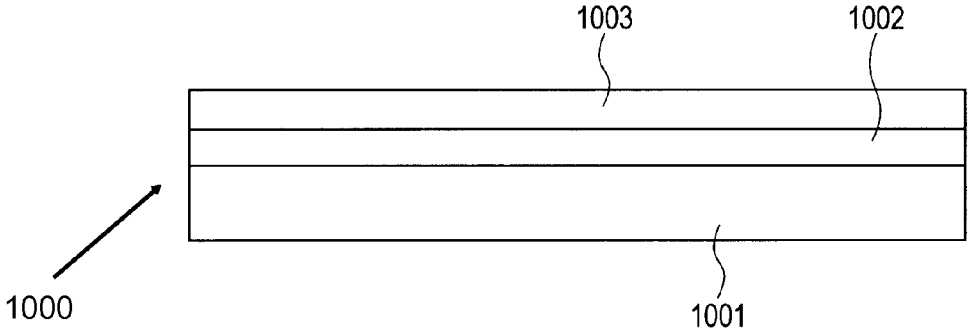
FIG. 10 is a partial sectional view of a fixing belt according to the present invention.

The stainless seamless belt obtained in this manner can be used as a fixing belt for use in a fixing belt for use in a heat fixing apparatus of an electrophotographic image forming apparatus. FIG. 10 is a schematic sectional view in a direction perpendicular to the peripheral direction of a fixing belt 1000 according to the present invention. In FIG. 10, the fixing belt 1000 according to the present invention includes a seamless belt 1001, an elastic layer 1002, and a toner releasing layer 1003. The elastic layer 1002 is disposed to secure a sufficient width of the fixing nip formed between the pressure roller and the seamless belt. The fixing nip allows an unfixed toner to be heat-fixed to a recording material without adding excessive pressure and thus a high quality electrophotographic image can be formed.

The material of the elastic layer 2 is not particularly limited, but any material excellent in heat resistance and thermal conductivity may be selected. Examples of the material of the elastic layer 2 can include at least one material selected from the group consisting of silicone rubber, fluororubber and fluorosilicone rubber, and particularly silicone rubber can be used. Specific examples of the material of the silicone rubber include polydimethylsiloxane, polymethyltrifluoropropylsiloxane, polymethylvinylsiloxane, polytrifluoropropylvinylsiloxane, polymethylphenylsiloxane, polyphenylvinylsiloxane, and polysiloxane copolymer.

In order to obtain excellent fixed image quality, the thickness of the elastic layer 1002 can be 10 μm or more and 1000 μm or less, and further can be 50 μm or more and 500 μm or less.

Examples of the material of the toner releasing layer 1003 include fluororesin, silicone resin, fluorosilicone rubber, fluororubber, and silicone rubber made of PFA (tetrafluoroethylene/perfluoroalkylether copolymer), PTFE (polytetrafluoroethylene), FEP (tetrafluoroethylene/hexafluoropropylene copolymer), and the like. In particular, PFA can be used because toner and the like are do not easily adhere to it.

Figure 2:
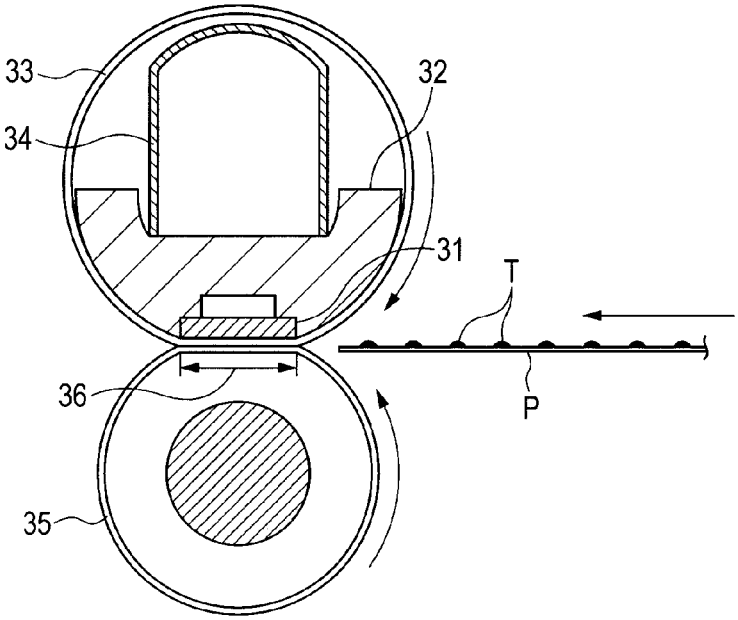
FIG. 2 is a schematic view illustrating an example of a schematic configuration of an image heating apparatus of a heat fixing type.

The fixing belt 33 used in the heat fixing apparatus illustrated in FIG. 2 can be replaced with the fixing belt 1000 according to the present invention to constitute the heat fixing apparatus according to the present invention.

The present invention can provide a stainless-steel seamless belt that is difficult to crack and break due to repeated bending, and excellent in durability. Further, the present invention can provide a fixing belt excellent in durability. Furthermore, the present invention can provide a heat fixing apparatus which can fix an unfixed toner image to a recording material in a stable manner.

Now, a method of manufacturing a stainless-steel seamless belt according to the present invention will be specifically described with reference to the embodiments given below.

First Embodiment

In the present embodiment, the stainless-steel seamless belt manufacturing method will be described in regard to separate steps from obtaining a first-stage metal tube to obtaining a fourth-stage metal tube.

(First-Stage Metal Tube)

Figure 5:
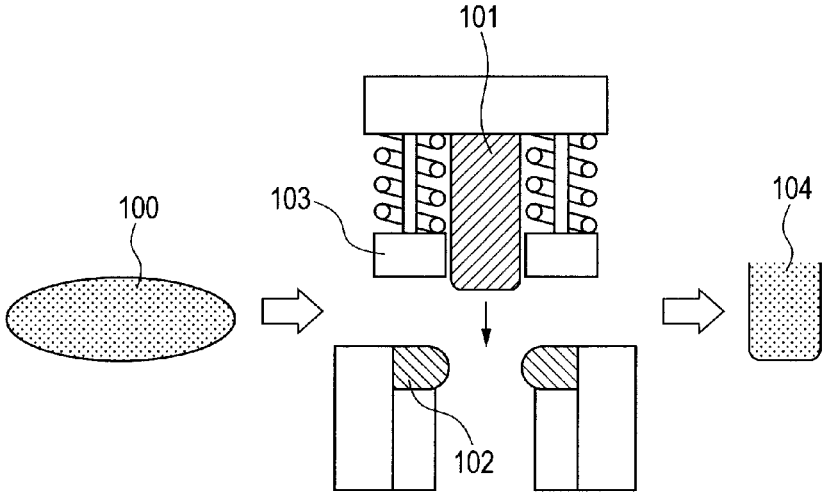
FIG. 5 is a schematic view illustrating a deep-drawing process used in the embodiments of the present invention.

FIG. 5 illustrates a method of manufacturing a first-stage metal tube by making use of a deep-drawing process. Here, a stainless-steel plate is subjected to a drawing process to obtain a first-stage metal tube (a cup-shaped member 104).

FIG. 5 includes a blank 100 which is a circular stainless-steel plate or a metal flat plate (blank) with a thickness of about 200 to 400 μm. FIG. 5 further includes a drawing punch 101 and a cylindrical drawing die 102 which is a mold made of a metal material having a surface subjected to super-hard plating.

In FIG. 5, the metal flat plate 100 is interposed between the drawing punch 101 and the drawing die 102, and then the drawing punch 101 is pressed down toward the drawing die 102 in a direction indicated by the arrow. At the same time, the metal flat plate 100 is sandwiched between a blank holder 103 and an upper surface of the drawing die 102 to be subjected to a drawing process so as to prevent wrinkling. Further, lubricating oil with high viscosity or a solid lubricant such as graphite and molybdenum disulfide is interposed between the metal flat plate 100 and the drawing punch 101 and between the metal flat plate 100 and the drawing die 102 to improve drawability.

The above steps are repeated, generally about 2 to 6 times so as to gradually reduce the cup diameter using different molds to perform a deep-drawing process to manufacture a cup-shaped member 104 made of metal. Note that the method of obtaining the metal cup-shaped member is not limited to the present embodiment, but a cup-shaped member may be obtained by impact molding, welding, cutting, or the like.

(Second-Stage Metal Tube)

Next, the cup-shaped member 104 is subjected to a plastic forming process to produce a bottomed cylindrical member 2. Then, the base portion of the bottomed cylindrical member 2 is cut away to obtain a thin-walled sleeve 1.

Figure 6:
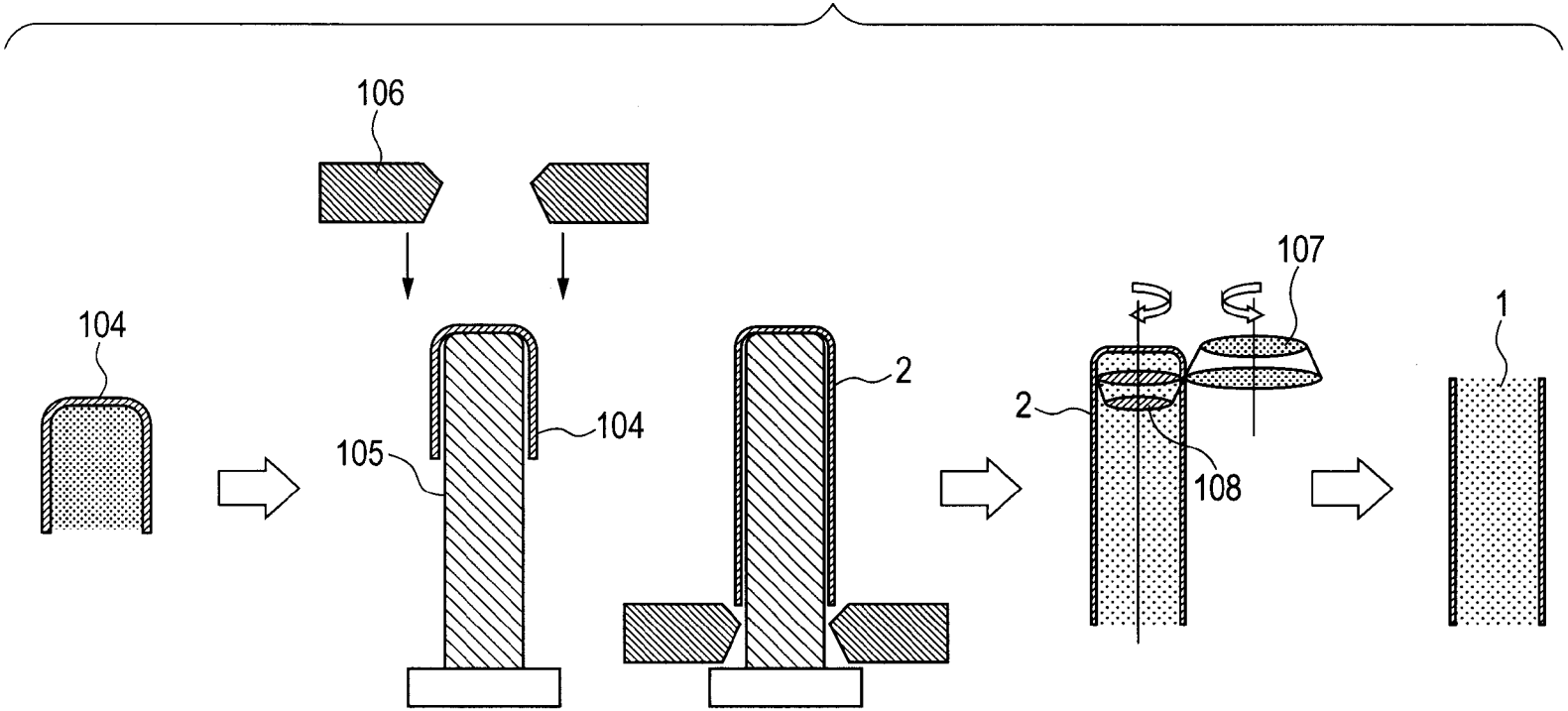
FIG. 6 is a schematic view illustrating steps of ironing and cutting used in the embodiments of the present invention.

FIG. 6 illustrates a series of steps in the second stage.

First, the cup-shaped member 104 manufactured in the first stage is placed on an ironing punch 105 in a manner to cover the front end of the ironing punch 105 as illustrated in FIG. 6. Then, an ironing die 106 is lowered in a direction indicated by the arrows so as to sandwich the metal cup-shaped member 104 therebetween to perform an ironing process in a gap between the ironing punch 105 and the ironing die 106. In the present embodiment, a plurality of ironing dies 106 with gradually reduced internal diameters are continuously lowered along the metal cup-shaped member 104 until a predetermined thin thickness is obtained. Note that the ironing method is not limited to the above method. For example, any plastic forming method capable of achieving a total ironing rate (plate-thickness reduction rate) of 75% or more may be applied to the ironing process for the cup-shaped member 104.

Then, the bottomed cylindrical member 2 is demolded from the ironing punch 105. Then, the base portion of the bottomed cylindrical member 2 is cut away by a cutting outer edge 107 and a cutting inner edge 108 to obtain the thin-walled sleeve 1.

(Third-Stage Metal Tube)

Next, the stainless-steel thin-walled sleeve 1 obtained in the second stage is subjected to a plastic forming process to further increase the dislocation density in the thin-walled sleeve 1. In the present stage of the manufacturing method, the thin-walled sleeve 1 obtained in the second stage is inserted into the interior of an outer die, pressurized from inside the thin-walled sleeve so as to cause the thin-walled sleeve to closely contact an inner wall of the outer die to expand the diameter of the thin-walled sleeve, namely, performing diameter expansion.

The present embodiment uses a diameter expansion method using hydraulic bulge forming as means of efficiently increasing the dislocation density of the thin-walled sleeve (stainless-steel seamless belt) subjected to the ironing process. The hydraulic bulge forming refers to a method of molding a metal tube into a desired shape by introducing a pressurized fluid into the metal tube to be processed to apply a pressure (hereinafter referred to as an internal pressure).

FIGS. 3A to 3D illustrate the hydraulic bulge forming method to be applied to the thin-walled sleeve 1 in the order of steps in the present stage. With reference to FIGS. 3A to 3D, a hydraulic bulge forming apparatus is illustrated which is composed of a bulge outer die 10 and a bulge inner die 20. The bulge inner die 20 is provided with an envelope structure of holding a rubber tube 24 with the aid of rubber tube holding members 21*a* and 21*b* so as to prevent a pressurized fluid 26 from leaking outside. When the pressurized fluid 26 is introduced from a pressurized fluid passage 25, the rubber tube 24 is expanded in a direction contacting the bulge outer die 10 to increase the diameter of the thin-walled sleeve 1.

Figure 3D:
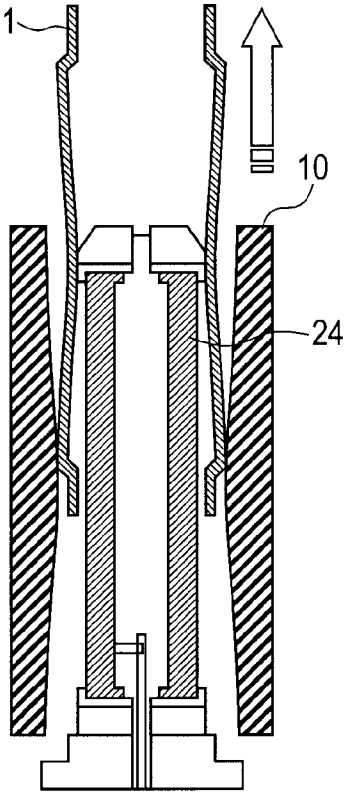
FIGS. 3A, 3B, 3C and 3D are a schematic view illustrating steps of the hydraulic bulge forming method for a seamless belt.
Figure 3C:
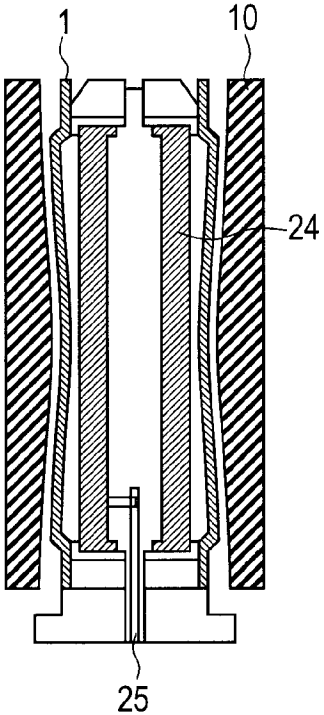
Figure 3B:
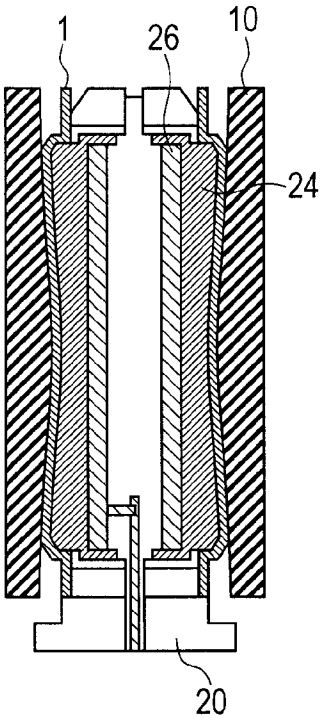
Figure 3A:
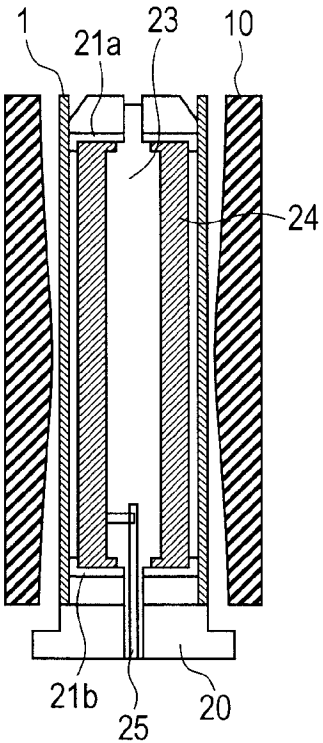

FIG. 3A is a cross-sectional view illustrating a state in which the thin-walled sleeve 1 is inserted into a bulge outer die of the hydraulic bulge forming apparatus. In the present embodiment, the thin-walled sleeve 1 manufactured in the second stage was subjected to a cleaning step to remove the lubricant attached during the ironing process in the second stage. Then, the thin-walled sleeve 1 was inserted into the bulge die.

FIG. 3B is a cross-sectional view illustrating a state in which an internal pressure load is applied to inside the bulge inner die 20. The rubber tube 24 is expanded by introducing a pressurized fluid through the pressurized fluid passage 25 to press the outer wall of the thin-walled sleeve 1 toward the inner wall of the bulge outer die 10. At this time, a space filled with the pressurized fluid 26 is created between the rubber tube 24 and an inner die axial center 23.

FIG. 3C is a cross-sectional view illustrating a state in which the pressurized fluid is removed from the bulge inner die 20 and after the pressurization step for the thin-walled sleeve 1 completes. The thin-walled sleeve 1 is in a state of being released from the state of closely contacting the bulge outer die 10 and is in a state of not contacting the rubber tube 24 or the bulge outer die 10.

FIG. 3D is a cross-sectional view illustrating a state in which the thin-walled sleeve 1 is being discharged from the hydraulic bulge forming apparatus.

Through the above steps, the third-stage metal tube can be thus obtained.

In the diameter expansion step applied to the thin-walled sleeve 1 illustrated in FIG. 3B, the diameter of the thin-walled sleeve 1 needs to be expanded without changing the length in the direction perpendicular to the peripheral direction of the thin-walled sleeve 1. By referring to FIGS. 1 and 4, the difference between the conventional hydraulic bulge forming method and the hydraulic bulge forming method of the present invention will be described in detail.

Figure 1B:
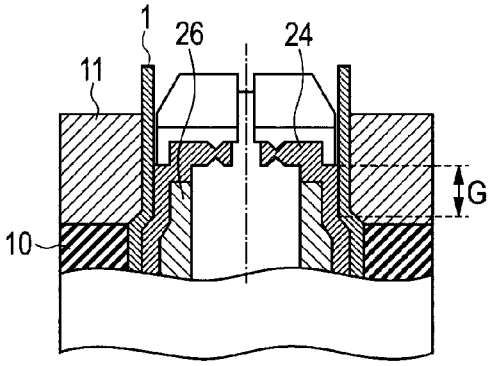
FIG. 1B is a during-internal-pressure-load state diagram of the hydraulic bulge forming method used in the embodiments of the present invention.
Figure 4A:
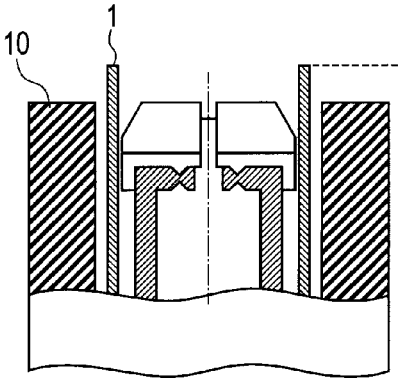
FIG. 4A is a before-internal-pressure-load state diagram of a conventional hydraulic bulge forming method.
Figure 4B:
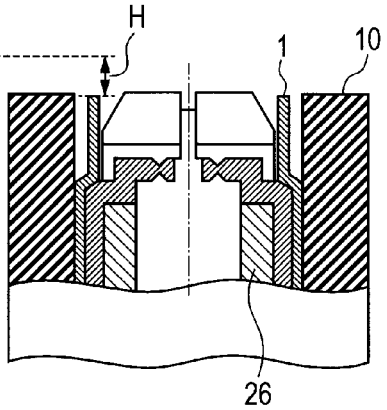
FIG. 4B is a during-internal-pressure-load state diagram of the conventional hydraulic bulge forming method.

FIGS. 4A and 4B are an enlarged view describing a change in the front end portion of the stainless-steel seamless belt between a state before an internal pressure load is applied and a state while an internal pressure load is being applied according to the conventional hydraulic bulge forming method. FIGS. 1A and 4B are an enlarged view illustrating a change in the front end portion of the stainless-steel seamless belt between a state before an internal pressure load is applied and a state while an internal pressure load is being applied according to the hydraulic bulge forming method of the present invention.

According to the conventional hydraulic bulge forming method illustrated in FIGS. 4A and 4B, when an internal pressure load is applied to expand the diameter of the thin-walled sleeve 1, the length of the thin-walled sleeve 1 in the direction perpendicular to the peripheral direction of the thin-walled sleeve is accordingly reduced. More specifically, when a comparison is made between the before-internal-pressure-load state and the after-internal-pressure-load state in which the thin-walled sleeve 1 is in a close contact with the bulge outer die 10, the length of the thin-walled sleeve 1 in the direction perpendicular to the peripheral direction of the thin-walled sleeve shrinks by H after the thin-walled sleeve 1 is brought into close contact with the bulge outer die 10.

In contrast to this, according to the hydraulic bulge forming method of the present invention illustrated in FIGS. 1A an 1B, a cylindrical binding member 11 having an internal diameter smaller than an internal diameter of the bulge outer die 10 is mounted on both ends of the bulge outer die 10. Although not illustrated in FIGS. 1A and 1B, a similar binding member 11 is mounted on opposite end sides of the seamless belt 1. A frictional force between the binding member 11 and the rubber tube 24 causes a fixing portion G to be formed in the end portions of the thin-walled sleeve 1. The fixing portion G allows the diameter of the thin-walled sleeve 1 to be expanded while suppressing a change in the length of the thin-walled sleeve 1 in the direction perpendicular to the peripheral direction of the thin-walled sleeve. In other word, as illustrated in FIGS. 4A and 4B, the present invention can suppress a generation of shrinkage H in the direction perpendicular to the peripheral direction of the thin-walled sleeve 1, which shrinkage may be due to diameter expansion.

Note that the unit for suppressing a change in the length of the thin-walled sleeve 1 in the direction perpendicular to the peripheral direction of the thin-walled sleeve is not limited to the present embodiment. For example, a method may be used such that a force in a direction opposite to that in the present embodiment, namely, a pressure is applied from an outer surface side of the stainless-steel seamless belt toward the axial center to fix the both end portions of the seamless belt and thereby suppress a change in the length of the belt in the direction perpendicular to the peripheral direction.

(Fourth-Stage Metal Tube)

Finally, in order to change movable dislocations grown by the plastic forming to fixed dislocations considered to be effective for bending resistance fatigue, the stainless-steel seamless belt (thin-walled sleeve) whose diameter is expanded in the third stage is subjected to low temperature annealing at 200 to 400° C. to obtain a fourth-stage metal tube. In the present embodiment, the fourth-stage metal tube was subjected to low temperature annealing for about 30 minutes in an electric furnace preliminarily heated to 300° C.

Evaluation Method (Bending Endurance Test)

Figure 8A:
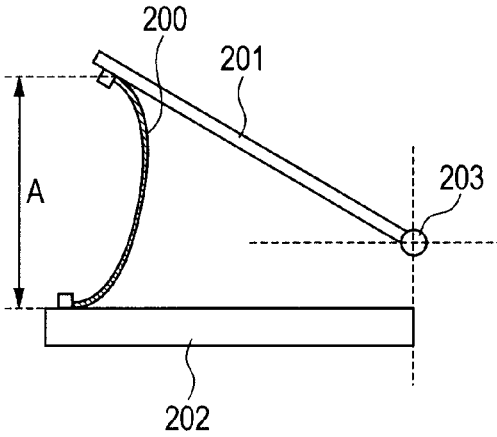
FIG. 8A schematically illustrates a state in which a bending tester used in the embodiments of the present invention is at top dead point.
Figure 8B:
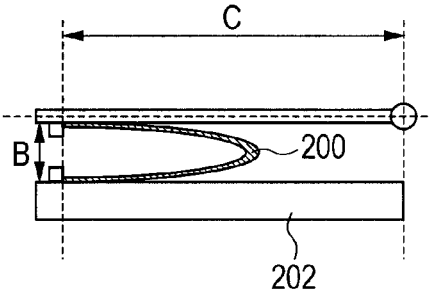
FIG. 8B illustrates a state in which the bending tester used in the embodiment of the present invention is at bottom dead point.
Figure 9:
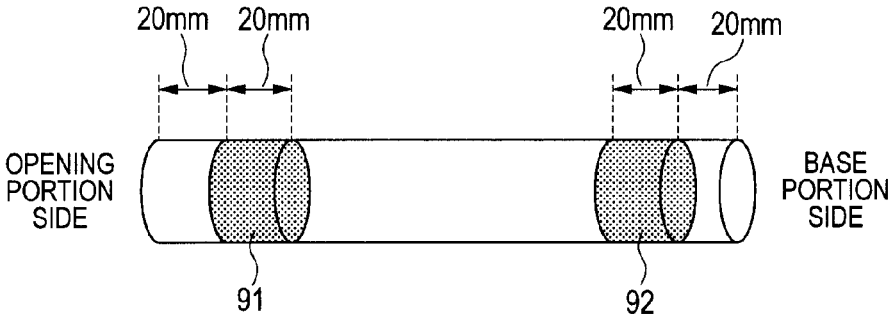
FIG. 9 is an explanatory drawing describing positions of cutting out a test specimen for bending durability and a test specimen for hardness measurement of the present invention.

FIGS. 8A and 8B illustrate a bending test method. First, a stainless-steel seamless belt is cut into a width of 20 mm in an axial direction and then cut open the belt in the direction perpendicular to the peripheral direction to obtain a 45 mm-long strip-like stainless-steel test specimen 200. FIG. 9 illustrates positions at which bending test specimen 91 is cut out from the stainless-steel seamless belt. The number of bending tests tended to be small on an opening portion side (ironing terminal portion side). Thus, the stainless-steel seamless belt was cut at a position 20 mm in the axial direction from the opening portion side (ironing terminal portion side) to obtain a test specimen.

FIG. 8A is a cross sectional view illustrating a state in which a test specimen 200 is attached to a bending endurance tester. The test specimen 200 was sandwiched between a horizontal base 202 and a side support plate 201 having a rotating shaft 203 on one side and rotating around the rotating shaft. At this time, the opening distance A of the test specimen 200 is 29 mm.

FIG. 8B is a cross sectional view illustrating a state in which the test specimen 202 receives a maximum bending in the tester for use in the present invention. At this time, the side support plate 201 and the horizontal base 202 are in a horizontal state where the opening distance B of the test specimen 200 is 5.5±0.2 mm.

In the bending tester, the side support plate 201 repeatedly reciprocated from a top dead point with an opening distance of 29 mm to a bottom dead point with an opening distance of 5.5 mm at a speed of 400 rpm. Then, the test specimen was visually checked for a crack to count the number of reciprocating movements until the crack was found. Note that the test specimen was sufficiently polished with #2000 sandpaper to such a state that the cut end surface did not affect the bending test results.

(Hardness Measurement)

Now, the hardness measurement method will be described. The hardness was measured in accordance with a test method conforming to IS014577-1.

FIG. 9 illustrates a position of cutting out a test specimen 92 for hardness measurement from the stainless-steel seamless belt. The test specimen was prepared by cutting the seamless belt into a width of 20 mm at a position 20 mm from the base portion side (ironing process starting side) and then cutting-open the belt in the direction perpendicular to the peripheral direction thereby providing a strip-like test specimen with a length of 45 mm. Then, the test specimen was bonded to a glass plate with an adhesive, Bond Aron AlphaPro No. 1 (product name of Konishi Co., Ltd.) such that an inner surface side scraping against the ceramic heater acts as a measurement surface. Subsequently, the test specimen was left for two days until completely dried. Then, a wrapping film corresponding to about 3 microns was used to polish the test specimen to such a state that the surface roughness of the measurement surface does not affect the hardness measurement.

As the measuring instrument, "FISCHERSCOPE HM2000" (product name) manufactured by Fischer Instruments K.K. was used. The load was applied so as to reach a measuring load of 500 mN in 20 sec from the time when an indenter contacted the test specimen and the state was held for 5 sec. At this time, the penetration amount of the indenter was about 2.5 μm.

The bending endurance test results and the hardness measurement results before and after the stainless-steel seamless belt obtained in the first embodiment was subjected to low temperature annealing are listed in Tables 1 and 2, respectively. The low temperature annealing increased the Vickers hardness by about 10%, as shown in Table 2, and the bending durability by about 110%, as shown in Table 1.

Note that in the bending endurance test, for the all the test specimens, a crack occurred in a position of the test specimen whose bending portion had a maximum curvature.

Second Embodiment

The second embodiment will focus on the manufacturing method after ironing and before cutting the metal cup-shaped member manufactured in the second stage of the first embodiment, namely, the method of subjecting the thin-walled bottomed cylindrical member 2 to a plastic forming process without changing the length in the direction perpendicular to the peripheral direction thereof.

In the same manner as in the first embodiment, a stainless-steel metal flat plate is subjected to a deep-drawing process to obtain a first-stage metal tube. Then, the first-stage metal tube is subjected to an ironing process to obtain a bottomed cylindrical member 2. The manufacturing method up to this has been described in detail in the first embodiment and thus the description is omitted here.

Figure 7A:
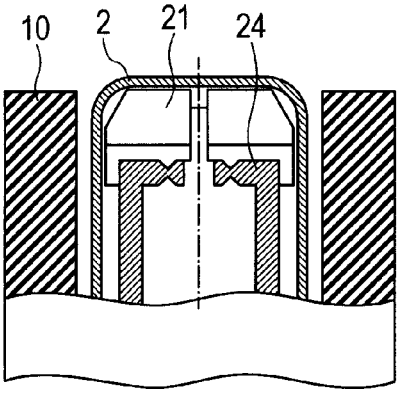
FIGS. 7A and 7B are a schematic view illustrating a hydraulic bulge forming method according to a second embodiment of the present invention.
Figure 7B:
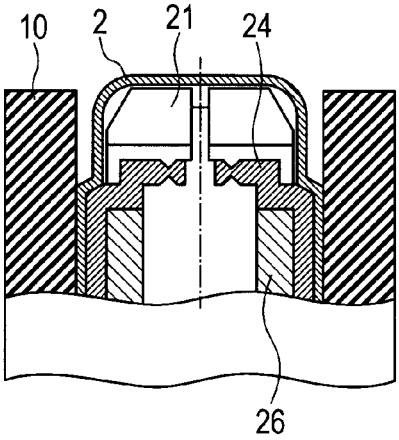

Next, a hydraulic bulge forming process is used as the diameter expansion unit to subject the bottomed cylindrical member 2 to a plastic forming process. FIGS. 7 and 7B illustrate a method of subjecting the bottomed cylindrical member 2 to a plastic forming process without changing the length in a direction perpendicular to the peripheral direction thereof. FIG. 7A illustrates a state in which the bottomed cylindrical member 2 is inserted into a bulge die. A slight pressure is applied to the bottomed cylindrical member 2 in a direction indicated by an arrow so as to allow the base portion thereof to surely contact the upper surface of a bulge inner die 21. Then, an internal pressure load is applied for diameter expansion as illustrated in FIG. 7B.

Conventionally, a shrinkage amount H occurs in the seamless belt as described in FIGS. 4A and 4B, but in the present embodiment, no shrinkage amount H occurs because the base portion of the bottomed cylindrical member 2 is clamped on the upper surface of the bulge inner die 21 to be fixed.

Although not illustrated in FIGS. 7A and 7B, the binding member 11 used in the first embodiment is mounted on the side of an opening end portion opposite to the base portion of the bottomed cylindrical member 2. In the same manner as in the first embodiment, a frictional force between the rubber tube and the binding member 11 causes the side of the opening end portion opposite to the base portion of the bottomed cylindrical member 2 to be fixed. Thus, the base portion of the bottomed cylindrical member 2 and the side of opening end portion opposite thereto are fixed, which enables diameter expansion without changing the length in the direction perpendicular to the peripheral direction of the bottomed cylindrical member 2.

Subsequently, in the same manner as in the first embodiment, the base portion of the bottomed cylindrical member 2 subjecting to the diameter expansion is cut and finally is subjected to low temperature annealing.

As described hereinbefore, the bottomed cylindrical member 2 with remaining base portion is used for diameter expansion, which enables the end portion on the base portion side of the cylindrical member 2 to be fixed even in a state in which the binding member 11 is not mounted on the bulge outer die 10 on the base portion side of the bottomed cylindrical member 2.

The first embodiment of mounting the binding members 11 on both sides has a disadvantage in that each time the seamless belt is inserted and discharged, at least one of the binding members needs to be removed from the bulge outer die 10, while the present embodiment has an advantage of eliminating such a cumbersome work.

The evaluation results of the seamless belt obtained in this manner are listed in Tables 1 and 2. The low temperature annealing has a great effect in that Vickers hardness increases by about 10% and the bending durability increased by about 100%.

Comparative Example 1

A stainless-steel seamless belt was obtained in the same manner as in the first embodiment except that after the ironing process, the low temperature annealing was carried out without performing the diameter expansion in the peripheral direction. The evaluation results of the seamless belt obtained in this manner are shown in Tables 1 and 2. The low temperature annealing has no great effect as compared with that in the first and second embodiments because the Vickers hardness increases by about 10% and the bending durability increases by about 10%.

Comparative Example 2

A stainless-steel seamless belt was obtained in the same manner as in the first embodiment except that the conventional hydraulic bulge forming method was used as a means for performing the diameter expansion in the peripheral direction. Note that the shrinkage amount H of the seamless belt occurring in the hydraulic bulge forming in the comparative example 2 was 0.3 mm on both ends.

The evaluation results of the seamless belt obtained in this manner are shown in Table 1. The low temperature annealing does not have so great effect as compared with that in the first and second embodiments because the Vickers hardness increases by about 10% and the bending durability increases by about 50%.

TABLE 1

| | Before low temperature annealing | After low temperature annealing |
|---|---|---|
| First embodiment 1 | 55,000 (n = 2) | 117,000 (n = 6) |
| Second embodiment 2 | 50,000 (n = 2) | 102,000 (n = 6) |
| Comparative example 1 | 45,000 (n = 2) | 50,000 (n = 6) |
| Comparative example 2 | 45,000 (n = 2) | 68,000 (n = 6) |

It is understood from the results in Table 1 that the number of times of bending until a crack is found greatly increased in the present embodiments than in the comparative examples in comparison between before and after the low temperature annealing.

TABLE 2

| | Before low temperature annealing | After low temperature annealing |
|---|---|---|
| First embodiment 1 | 430 | 486 |
| Second embodiment 2 | 440 | 495 |
| Comparative example 1 | 444 | 484 |
| Comparative example 2 | 450 | 494 |

Thus, as described hereinbefore, the metal tube subjecting to the ironing process is subjected to the plastic forming process for diameter expansion without changing the length in a direction perpendicular to the peripheral direction, followed by the low temperature annealing process, which can provide a metal seamless belt having highly durable bending fatigue characteristics while maintaining high hardness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-161411, filed Jul. 16, 2010, and Japanese Patent Application No. 2011-151979, filed Jul. 8, 2011, which are hereby incorporated by reference herein in their entirety.

What is claimed is:

1. A method of manufacturing a stainless-steel seamless belt, comprising: the steps of:

(1) obtaining a cup-shaped member by subjecting a stainless-steel plate to a drawing process;

(2) obtaining a thin-walled sleeve by subjecting the cup-shaped member to a plastic forming process to be thin-walled and cutting a base portion of the thin-walled cup-shaped member;

(3) inserting the thin-walled sleeve into a cylindrical outer die having an internal diameter larger than an external diameter of the thin-walled sleeve so as to be coaxial with the cylindrical outer die, pressurizing the thin-walled sleeve from an inside thereof so as to cause the thin-walled sleeve to closely contact an inner wall of the outer die, and thereby expanding a diameter of the thin-walled sleeve; and (4) subjecting the thin-walled sleeve whose diameter is expanded in (3) to low temperature annealing at 200 to 400 degree C., wherein the step (3) includes expanding the diameter of the thin-walled sleeve without changing the length in a direction perpendicular to the peripheral direction of the thin-walled sleeve.

2. The method of manufacturing a stainless-steel seamless belt according to claim 1, wherein:

in step (3), both ends of the thin walled sleeve are fixed so as to prevent a change in the length in a direction perpendicular to the peripheral direction of the thin-walled sleeve.

* * * * *